United States Patent [19]

Gralinski

[11] 3,960,023

[45] June 1, 1976

[54] STORED ENERGY EJECTOR MECHANISM

[75] Inventor: Edward Richard Gralinski, Andover, N.J.

[73] Assignee: Donley, Miller & Nowikas, East Hanover, N.J.

[22] Filed: June 9, 1975

[21] Appl. No.: 584,953

[52] U.S. Cl. ..... 74/2; 83/82; 83/160; 100/218; 214/1 BB

[51] Int. Cl.[2] ..... G05G 17/00

[58] Field of Search ..... 74/2; 83/82, 160; 100/218; 214/1 BB

[56] References Cited

UNITED STATES PATENTS

| | | | |
|---|---|---|---|
| 2,470,266 | 5/1949 | Richter | 74/2 X |
| 2,956,664 | 10/1960 | Brown et al. | 214/1 BB X |
| 3,337,104 | 8/1967 | Wilson | 74/2 X |
| 3,593,561 | 7/1971 | Roth | 83/82 X |
| 3,910,125 | 10/1975 | Nowikas | 74/2 |

*Primary Examiner*—Allan D. Herrmann
*Attorney, Agent, or Firm*—Ralph R. Roberts

[57] ABSTRACT

A stored energy ejector mechanism is disclosed and described and includes an ejector plunger member which is propelled by a spring-bias induced by an actuator lever actuated by a stroke of a punch press and the like. The stored energy in these springs is released and the propelling or ejection motion of a plunger member is begun by the actuation of a trigger mechanism whose release time is selectively established and preferably occurs during the same stroke of the press mechanism in which is produced the loading of the springs. Although primarily for use with a punch press to provide a substantially quiet ejector action, this stored energy is equally applicable to other operations such as providing an ejector mechanism for use with a conveying or line inspection system employing linear motion.

12 Claims, 7 Drawing Figures

STORED ENERGY EJECTOR MECHANISM

CROSS-REFERENCE TO RELATED APPLICATION

This invention is an improvement of U.S. patent application Ser. No. 485,499, filed July 3rd, 1974 and having the same title and filed in the name of Walter M. Nowikas. This application is now U.S. Pat. No. 3,910,125. This patent and the present application are assigned to the same assignee.

BACKGROUND OF THE INVENTION

1. Field of the Invention

With reference to the classification of art as established in the United States Patent Office the present invention pertains to art as found in the general Class entitled, "Material or Article Handling" (Class 214) and the subclass entitled, "transfer devices — reciprocating type" (subclass 1BB). Also of note is the art in the general Class entitled, "Machine Elements and Mechanisms" (Class 74) and the subclass entitled, "automatic operation or control" (subclass 2).

2. Description of the Prior Art

Spring-type ejector pins and levers used with punch presses and mounted dies are well known and are often designed and furnished as a basic component of dies used with and in punch press operations. Hold-downs and step-wise advancing mechanisms are also well known in the punch press industry. In recent years for difficult high speed removal of a product there has been used a controlled jet of air providing an ejector means to blow formed, sheared, or compound-formed and sheared members from dies and the like. These jets of air in combination with the removal action of the piece parts are often noisy and in certain circumstances approach, if they do not exceed, the permissible tolerant noise levels now established by Federal law.

The present invention provides apparatus that is relatively silent during ejecting action and during the extending of the tension springs, as well as virtually silent or completely silent during all other phases of operation. The force required to extend the springs is small and is exerted during that part of the press ram movement which occurs during a portion of the travel stroke not immediately used for forming or cutting of the product part. The present invention permits the loading and ejecting cycle to be adjusted to suit the operating cycle. In particular, when used with a forming die the trigger is adjusted so that the ejector release motion occurs only after the die has opened a selected amount. It is to be noted that simple mechanical actions and components are employed so that the service life expectancy of the ejector mechanism and its components is in the millions of cycles. Its adaptability to punch press and similar operations with a minimum of design consideration is also a great assistance to the designer. An ejector mechanism is provided which does not require pressurized air to remove items from a transport means.

The ejector mechanism utilizes a spring-biased plunger which is energized by a movement of the associated apparatus. A coupled pair of actuator levers is moved to load springs connected to the ejector plunger and the springs and plunger are maintained in the desired loaded or cocked condition until a trigger is actuated to release the ejector plunger which is moved a determined distance under the influence of the released springs. The releasing of the ejector plunger usually occurs in the up stroke portion of the press cycle and after forming and/or cutting. The release of the spring stored energy causes the ejector plunger to move a desired distance and engage and dislodge that piece which is to be ejected.

SUMMARY OF THE INVENTION

This invention may be summarized at least in part with respect to its objects.

It is an object of this invention to provide, and it does provide, a stored energy ejection mechanism wherein an ejector plunger is propelled by a spring-biased means which is loaded by utilizing a downward stroke of a punch press and the like. A trigger retains the plunger in a cocked condition until the stored energy is released by the actuation of the trigger mechanism whose release is selectively timed to occur within the upward limit of movement of the cocking mechanism.

It is a further object of this invention to provide a simple, relatively quiet, stored energy ejector mechanism having an ejector plunger which may be positioned at any desired relationship with a product member to be ejected from its placed position. A pair of compression springs are compressed by the downward movement of the punch press and this stored energy is used to move a coupled pair of actuator levers which cause a pair of springs to be tensioned. These springs are attached to an ejector plunger. A trigger mechanism holds this ejector plunger in this cocked position until the trigger is actuated by means in association with the punch press stroke. The actuated trigger causes a release of the ejector plunger and permits it to move quite rapidly under the influence of the tensioned springs.

The ejector mechanism of this invention is adapted for use with a punch press or a transport mechanism where its energy is stored and released by associating the mechanism with the movement of a ram of the press or a member of the transport mechanism. In a housing attached to a fixed portion of the press is slidably carried an ejector plunger actuated by a pair of tension springs which is attached to the plunger and the housing and urges the plunger to one extreme of travel. A coupled pair of actuator levers is actuated by an energizing shaft moved downward by and in response to the movement of the ram of the press. A pair of compression springs is also substantially compressed during the downward stroke and provides additional loading means. During the upward stroke of the press the actuating levers are urged by compression assist springs to stretch further the associated tension springs and move the ejector plunger to its loaded position. A trigger mechanism including a sear member, a stop shoulder on the ejector plunger, and a sear lifter also actuated in response to the upward stroke of the energizing shaft releases the ejector plunger which rapidly moves to its unloaded position. This plunger is positioned to provide the desired ejecting action and the trigger mechanism is adjustable to cause a stroke related released of the ejector plunger.

To the extent applicable the structure shown and described in U.S. application Ser. No. 485,499 filed July 3, 1974 now U.S. Pat. No. 3,910,125 in the name of Walter M. Nowikas is incorporated by reference into this application. The reference application and the present application have a common assignee. The improvement provided in the present invention is the elimination of the connection of the ejector mechanism to the ram of the punch press or like device. The improved mechanism requires only the downward force of the punch press and employs a pair of compression springs to assist in the loading of the associated plunger springs.

In addition to the above summary the following disclosure is detailed to insure adequacy and aid in understanding of the invention. This disclosure is intended to cover each new inventive concept no matter how it may later be disguised by variations in form or additions of further improvements. For this reason there has been chosen a specific embodiment of the stored energy ejector mechanism as adopted for use on punch presses and transport mechanisms and showing a preferred means for loading and stroke related releasing of an ejector plunger. This specific embodiment has been chosen for the purpose of illustration and description as shown in the accompanying drawings wherein:

BRIEF DESCRIPTION OF THE DRAWINGS

In the following description and in the claims various details will be identified by specific names for convenience; these names, however, are intended to be generic in their application. Corresponding reference characters refer to like members throughout the several figures of the drawings.

Figure 1:
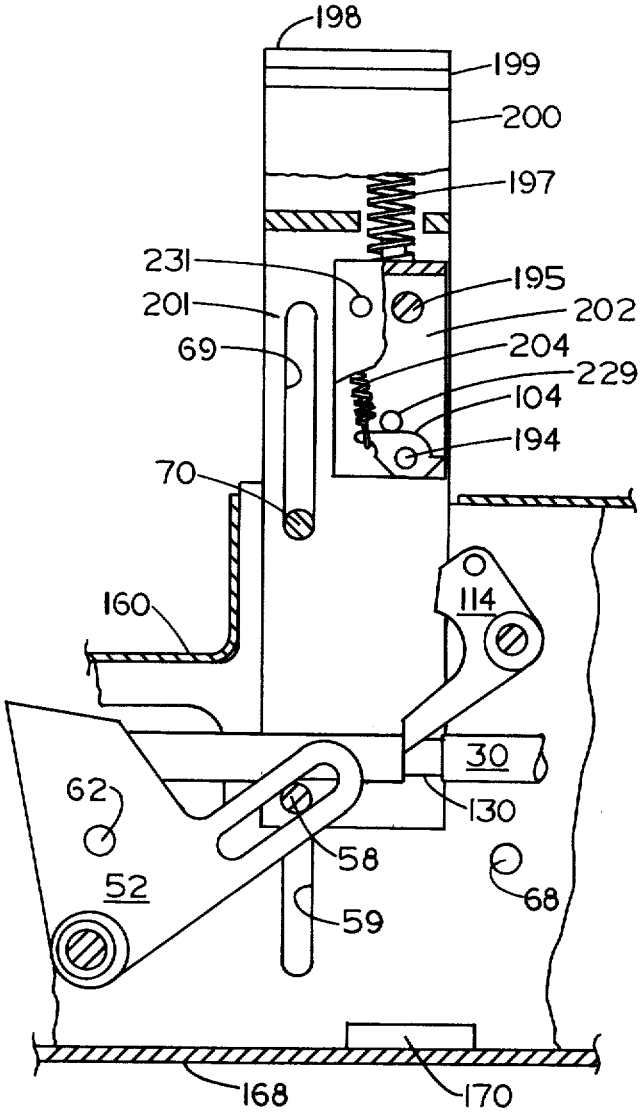
FIG. 1 represents a side view, partly schematic, of the ejector mechanism with the ejector plunger in its loaded condition and with the spring cocking actuator levers moved into their spring loading condition and with the trigger actuation moved into holding position, this occurring when the outer fork has reached the upward limit of its motion.

The drawings accompanying, and forming part of, this specification disclose specific details of construction for the purpose of explanation of the broader aspects of the invention, but it should be understood that structural details may be modified and that the invention may be incorporated in other structural forms than shown.

DESCRIPTION OF THE PREFERRED EMBODIMENT

As seen in the drawings and in FIGS. 1–7 therein, there is disclosed a preferred embodiment of an ejector mechanism and showing in detail the relationshp of the several components and their interaction as they provide the loading, cocking and then the release of an ejector plunger. It is, of course, realized that many different sizes and modifications of the embodiment shown may be made, however, for the purpose of the explanation and relationship of the components it is to be noted that, as depicted, a reduced-to-practice mechanism is shown in a substantially three-quarter to full size scale and represents an ejector stroke length of approximately one and one-quarter inches maximum, and one-half inch minimum. Obviously, apparatus larger and smaller may be constructed and the extent of the stroke is only a matter of design selection. Reference is particularly made to application Ser. No. 485,499 which employs much of the mechanism herein shown and described.

As depicted, the apparatus includes a housing 20 which may be a cast unit having end portions 22 and 24 in which are formed guideways 26 and 28, not shown, but seen in FIG. 1 of the reference application. These guideways form and provide bearing means to slidably carry an ejector plunger 30. This plunger carries on its left end an adjustable split clamp collar 32. A cap screw 33 is preferably used to tighten this collar at the desired position on plunger 30 or, as an alternate means, a threaded arrangement may be provided. An impact absorber 34 which is washer-shaped and of a resilient material absorbs the abrupt stop forward motion when the plunger is released. In addition to absorbing the shock the sound energy is reduced by this absorber which is mounted on the end portion 24 and is disposed between the collar 32 and the housing end 24. Carried on this plunger is a plunger spring anchor 36. A forward shoulder 39 formed by making the rear portion of the plunger a reduced diameter also prevents unwanted forward movement of anchor 36 on the ejector plunger 30. Attached to the outwardly extending rod portions of this anchor 36 and by one end thereof are like extension springs 40 and 42, seen in FIG. 6. These extension springs 40 and 42 are stretched to provide a determined amount of tension.

Actuator lever hub 50 is carried by a clevis pin 51 whose ends are mounted in and extend from the two side walls of the housing 20. Mounted on hub 50 as a matched pair is near and far actuator levers 52 and 54. The forward or rightwardly extending portions of these levers freely pass inside a vertically disposed energizer fork 201 which carries a clevis pin 58 in its lower end. Pin 58 is vertically slidable in slots formed in the side wall of the housing 20. This clevis pin is also slidable in slot 60 formed in the near lever 52 and in a like slot 61 formed in far lever 54. An actuator lever spring pin 62 is carried in levers 52 and 54 and extends through a cutout in the far wall of the housing 20. At this extending end of the pin is attached one end of an extension spring 66. The other end of this spring is attached to a spring anchor post mounted in the far wall of the housing 20. Spring 66 in mounted condition is in tension and urges lever members 52 and 54 in a clockwise direction as viewed in FIG. 1.

Figure 4:
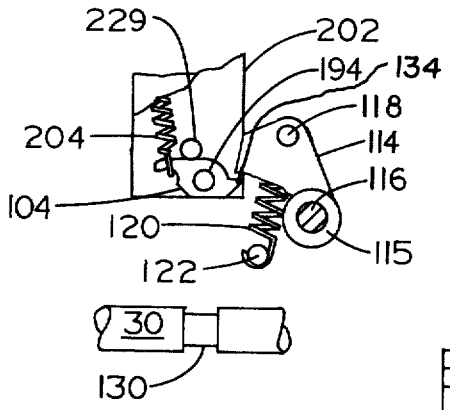
FIG. 4 represents a fragmentary view of the trigger mechanism and showing the sear lifter as it approaches the sear to cause the sear to be rotated and to release the energized plunger for rapid movement of the plunger to the right.
Figure 5:
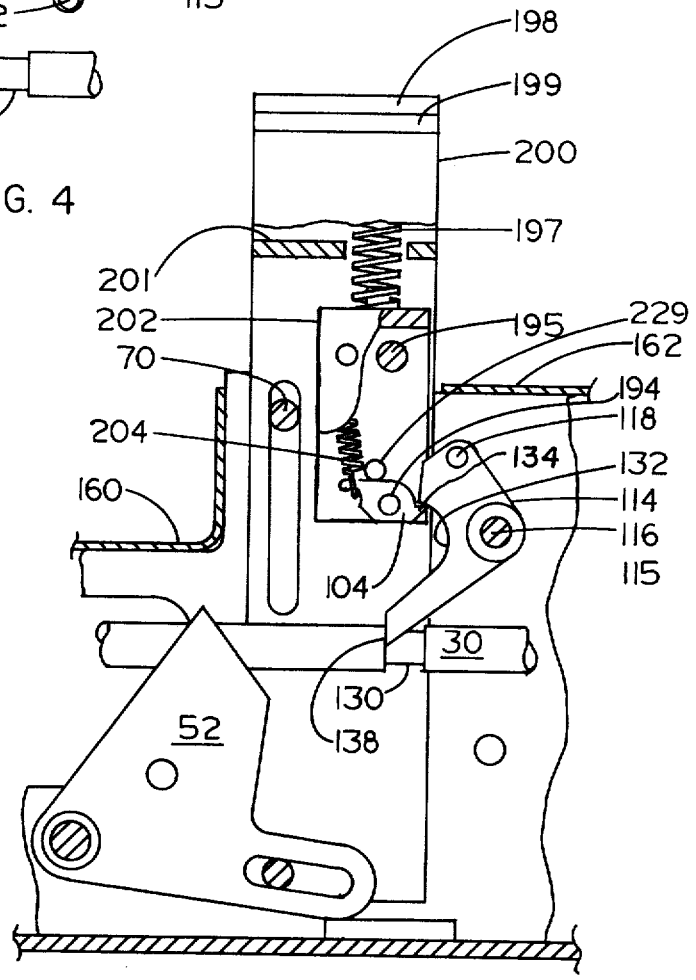
FIG. 5 represents a sectional side view of the mechanism as in FIG. 3 and with the outer fork moved upwardly prior to the movement of the sear lifter into sear disengaging position, this is just prior to a further lift required to create the plunger release.

Referring now in particular to the plunger retaining and release means, it is to be noted that as seen in FIGS. 4 and 5 sear release lifter 104 is to the left of a sear 114 which has a general C-shape. This sear 114 is spaced from the side walls of housing 20 by sear hubs 115 and is pivotally retained on a shaft 116 which extends between and is retained in holes formed in the near and far side walls of said housing 20. The upper portion of this sear has a spring anchor 118 which is a short pin mounted in a hole formed in the sear. One end of an extension spring 120 is secured to this anchor 118 and the other end of the spring 120 is mounted on a pin 122 which is seen in FIG. 4. This pin 122 is mounted in the far wall of the housing 20. Spring 120 urges the sear 114 in a counterclockwise direction around shaft 116. The lower left portion of the sear 114, as seen in FIG. 5, has a depending tail portion which contains the means providing the forward stop for the movement of the ejector plunger 30 when and as it is moved to the loaded condition.

It is to be noted that pin 122, as seen in FIG. 4, provides a dual function. It not only secures one end of spring 120 but also insures that if spring 204 breaks or the sear lifter 104 is slow in responding to the downward movement of the actuator mechanism the lifter will be cammed into engaging position with and at the termination of the downward movement.

In certain instances, it may be desirable that spring 204 be eliminated and that the camming action of the sear lifter 104 as it engages pin 122 be used instead. If and where the pin 122 is to be used exclusively to rotate sear lifter 104 to the engaging position, a roller may be supplied on pin 122 to reduce wear.

As shown in detail in the reference application, the depending end of sear 114 is formed with an arcuate cutout which to a large extent is compatible with a reduced diameter portion 130 formed in the plunger 30. This arcuate portion of the sear is urged by spring 120 into sliding engagement with that larger diameter portion of plunger 30 which is to the left of reduced diameter portion 130. As the plunger 30 is moved leftwardly to the loaded condition the arcuate portion of the sear end slides on the upper surface of the plunger 30 until the reduced diameter 130 is brought in way of this arcuate end portion. At this point and urged by spring 120 this depending end of the sear is pulled into reduced diameter 130 and in this position the left shoulder of the reduced diameter portion 130 is engaged by this depending tail of the sear as the leftward movement of the plunger is stopped. The sear 114, in the holding condition of FIG. 5, retains the ejector plunger 30 in the "loaded" condition until the release action of the sear lifter 104 causes the sear 114 to be disengaged.

The upper left edge of the sear 114, as seen in FIG. 5, is formed with an arcuate cam surface 132 whose upper left end provides a shoulder portion in the path of a trigger projection portion 134 of the sear lifter 104. This lifter is rotatable clockwise around sear lifter axle 194 until this projection 134 engages stop pin 229. Extension spring 204 draws the pivoted sear lifter into the lifter engaging condition of FIG. 5 with the upper surface of the lifter held against pin 229 when and as the projection portion of the lifter moves upwardly into engagement with the upper portion of cam surface 132.

Figure 7:
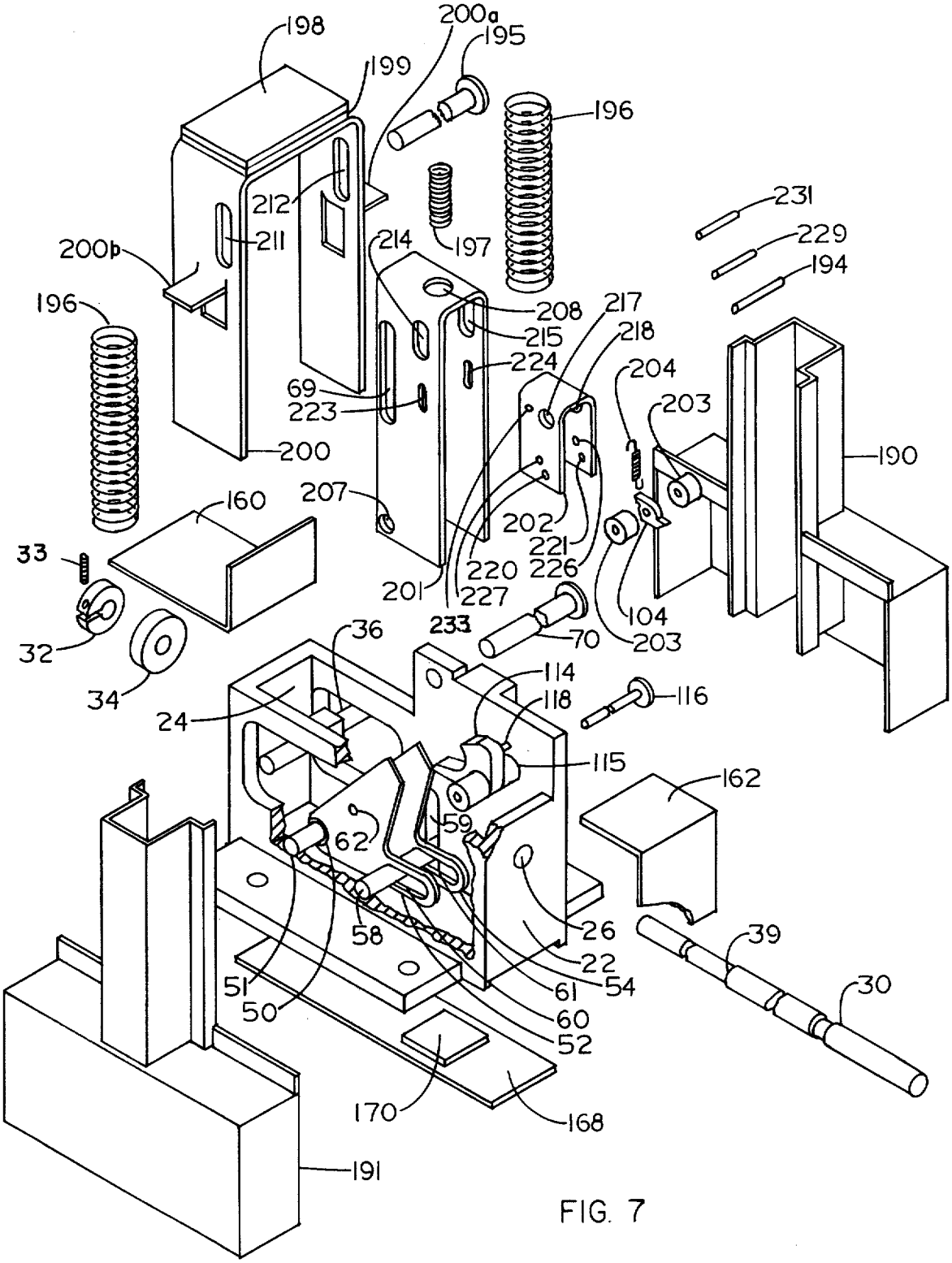
FIG. 7 represents an exploded isometric view of the mechanism with portions of the components broken away to more clearly show the inner construction and relationship of certain components.

As seen in FIG. 7, an energizer cover 160 is mounted on the upper left surfaces of housing 20. A sear cover 162 is also secured to the sides of the housing 20 to cover the front opening above the plunger guideway 26. Far and near side covers 190 and 191 are secured to the sides of housing 20 to guard the moving parts in the housing from damage and also to provide spring guideways for compression springs 196. A bottom cover 168 carries an impact absorber pad 170 which engages the bottom sides of levers 52 and 54 to limit the turning of these levers around clevis pin 51.

As seen in FIG. 1, the plunger 30 is in an energized or cocked condition. The sear 114 has dropped into a plunger retaining condition with the depending end having the cutout laying in reduced diameter portion 130. The sear 114 is in the trigger retaining condition for holding the plunger 30 against rightward movement while the sear lifter 104 is in its uppermost position as carried with and by the upward movement of an outer fork 200 and springs 196. Also seen in FIG. 1 is clevis pin 58 which has been moved to the upper limit established by guide slots 59 formed in the side wall of the housing 20.

Figure 2:
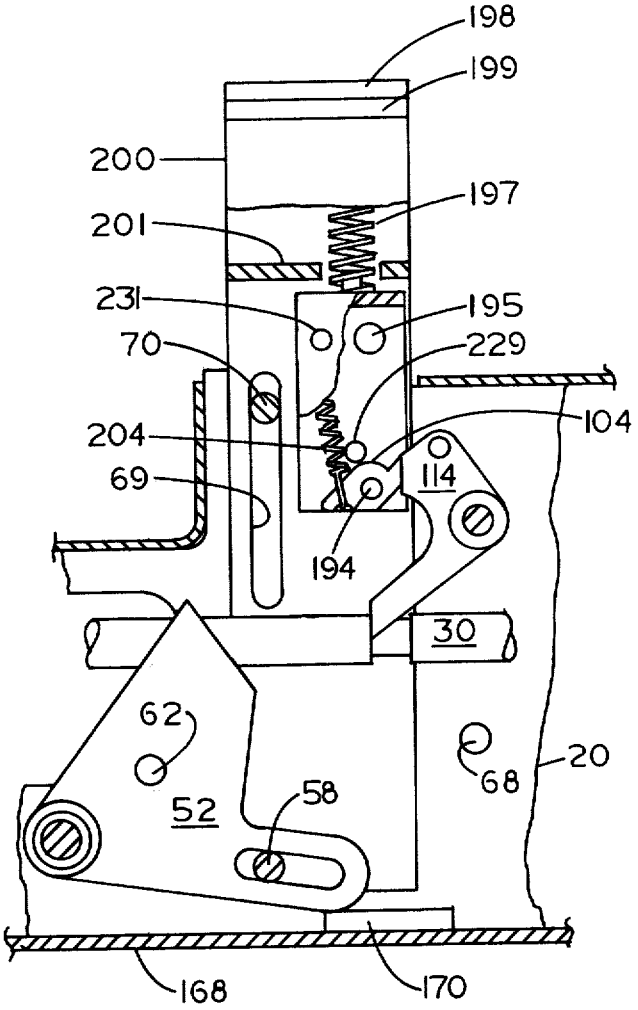
FIG. 2 represents the side view of the mechanism as in FIG. 1 but with the outer fork in the process of being moved toward the bottom of its stroke and with the sear lifter of the trigger mechanism wiping past the sear member.
Figure 3:
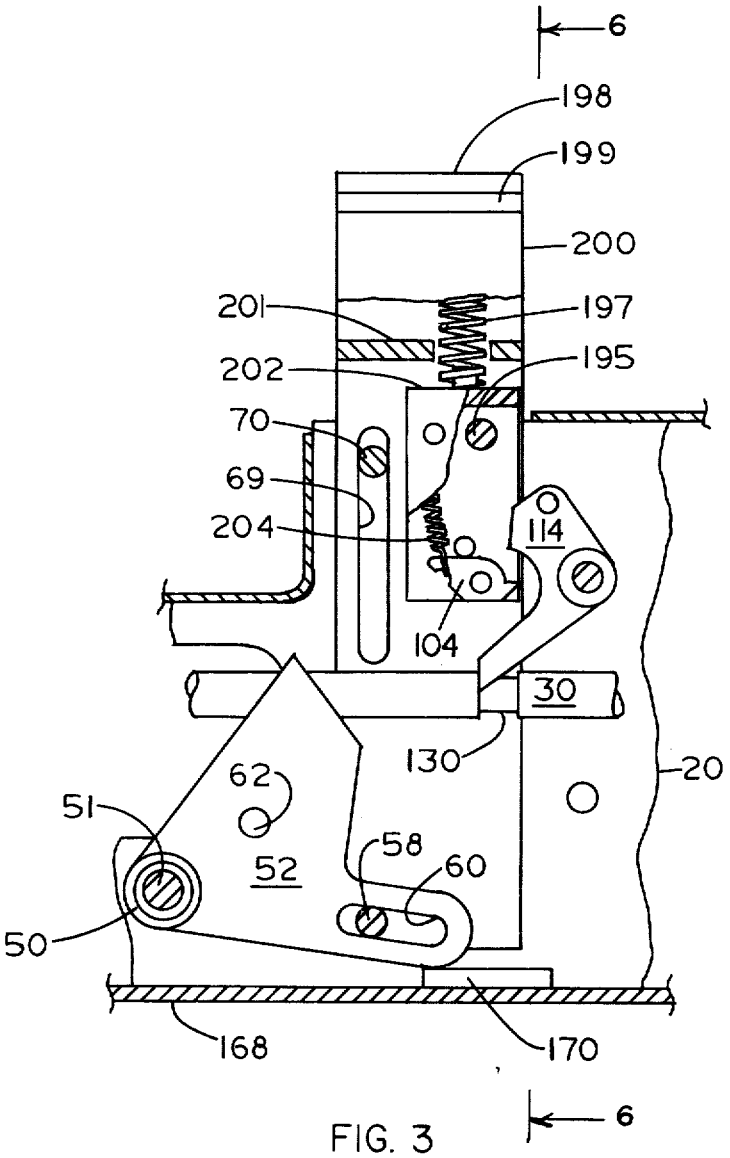
FIG. 3 represents a side view of the apparatus as in FIG. 2 but with the outer fork and the associated energizer fork in the completely bottom position and with the trigger mechanism being brought to a cocked condition prior to the upward motion of the outer fork.

In FIG. 3, the outer fork 200 is shown at its bottom limit as moved by the downward stroke of a punch press or other mechanism. The upper and lower dies, where used as with a punch press, are fully closed to perform whatever operation is to be done upon the workpiece, not shown. A sear lifter fork compression spring 197 is in a compressed condition and the sear lifter 104 has passed by the sear 114 on its way down as in FIG. 2. The rotation of the sear lifter 104 is about sixty or seventy degrees as it engages and passes by the sloped part of the sear and is counterclockwise around the pin 194. As and after the sear lifter has been moved to its lower limit, as established by the stop pin 122, the desired amount of lost motion in the trigger is provided. This occurs with the upward movement of the outer fork 200. This determined lost motion occurs as the outer fork 200 makes its upward travel. It is to be noted that in FIG. 5 the actuator levers 52 and 54 are in the lowermost position and the ejector plunger 30 is in a "cocked" condition. The stop collar 32 is secured on plunger 30 at a determined distance which establishes and limits the extent of the rightward travel of the ejector plunger.

Still referring to FIG. 5, the outer fork 200 has been carried upwardly by the springs 196 until the sear lifter 104 is nearly in engagement with the sear 114. Further movement upwardly of about one-quarter inch will cause the sear to be rotated clockwise around pin 116. A slight amount of this clockwise movement of the sear is necessary to cause the engaging portion containing the arcuate U-shape cutout portion of the depending end to slide up the shoulder 138. When free, the plunger 30 is released to move rightwardly until the collar 32 engages the impact absorber 34. Collar 32 limits the movement of the plunger to its rightward position. This travel and limit extent of the ejector plunger 30 may be from one-half inch to one and one-quarter inches.

ENERGIZER MECHANISM

The energizer mechanism of this invention although it utilizes a downward stroke such as from a punch press for the loading of the plunger mechanism is not intended for attachment to the ram and does not require connection to a press ram or the like in order to utilize the upward stroke force of such an auxiliary mechanical power device.

Figure 6:
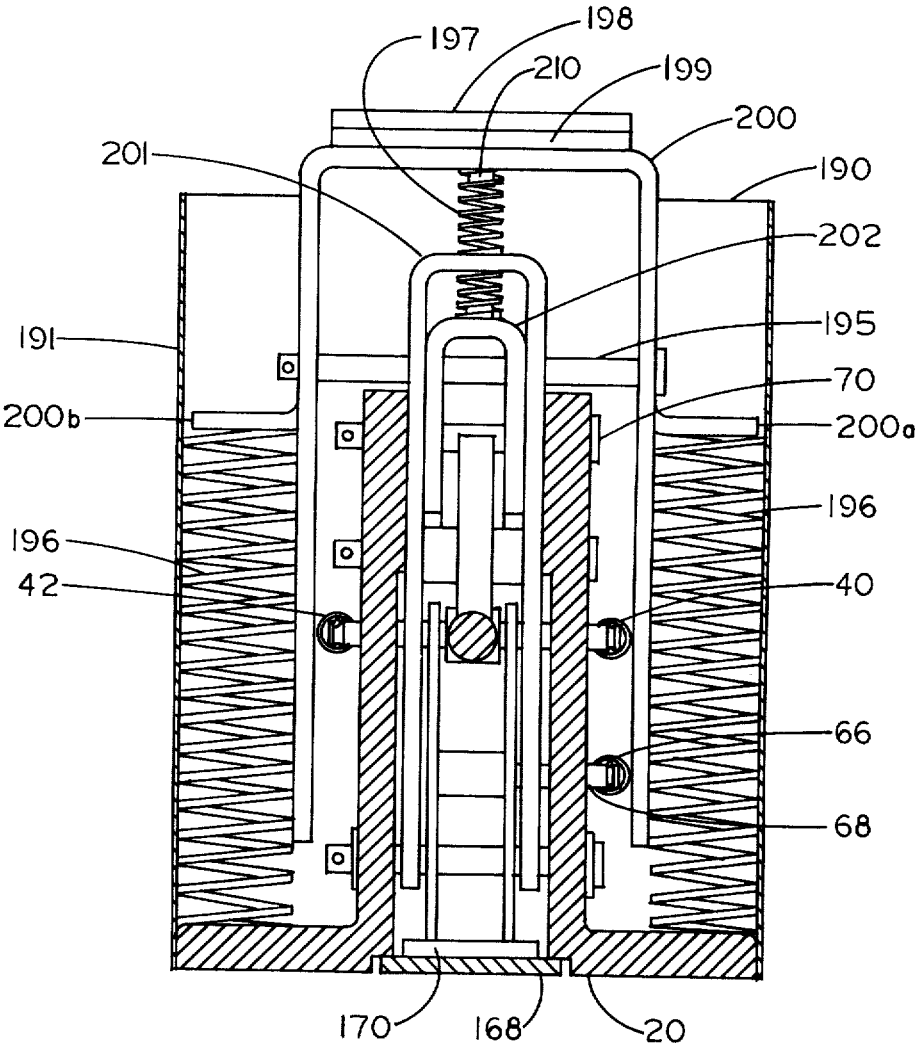
FIG. 6 represents a sectional view taken on the line 6—6 of FIG. 3 and looking in the direction of the arrows and showing in particular the outer fork and the pair of compression springs which are used to provide upward loading and trigger release.

In the present embodiment as particularly seen in FIGS. 6 and 7, the energizer mechanism assembly includes outer side housings 190 and 191 which are attached to body 20 and in which there are formed guideways and retaining means for compression springs 196. Outer fork 200 has extending wings or tabs 200*a* and 200*b* which are disposed to engage the upper ends of compression springs 196. These springs are carried within the channel guides provided by the side members 190 and 191. The lower ends of the springs 196 rest upon outwardly extending flange portions of the body 20. The top of this outer energizer fork 200 has a shock absorber 199 of a determined resilience. Above pad 199 is a striking plate 198 which usually is constructed of metal.

Pin 195 is carried in holes 217 and 218 in the sear lifter fork 202 and extends through the slots 214 and 215 in the energizer fork 201 and also slidably extends through slots 211 and 212 in outer fork 200. Vertical guide movement of the outer fork 200 in relation to the energizer fork 201 is permitted to the extent allowed by these slots 211 and 212. Spring 197 urges the sear lifter fork 202 downwardly to provide a lost motion of about one-quarter inch between energizer fork 201 and sear lifter fork 202. This is shown in FIGS. 3 and 5 and insures initial upward movement of the outer fork 200 before release of the ejector and resetting of the trigger. Holes 220 and 221 in sear lifter fork 202 carry sear lifter pin 194. Above these holes are holes 226 and 227 in which is mounted a pin 229. This pin, as seen in FIG. 1, provides a limiting stop against clockwise rotation of the sear lifter 104 which is urged into an engaging position by means of spring 204. Also carried by the sear lifter fork 202 is a pin 231 which is mounted in aligned holes 233 in the sear lifter fork 202. This pin provides an attaching means for securing the upper hook end of spring 204 to provide the desired rotative urging of the sear lifter 104.

In an assembled condition, the sear lifter fork 202 is slidable within the inner walls of the energizer fork 201. Sear lifter 104 is pivotally retained by shaft 194 mounted in holes 220 and 221 and by means of spacers 203 the sear lifter 104 is positioned midway of the side walls of the sear lifter fork 202. The lower hook portion of spring 204 engages the leftward extending end portion of the sear lifter 104. The upper end of the spring 204 is secured to pin 231 carried in the sear lifter fork. Pin 194 is secured in the sear lifter fork 202 and extends into the slots 223 and 224 of energizer fork 201 to act as a lower vertical guide means of the sear lifter fork 202. On the upper portion of the outer fork 200 is provided a wear plate 198 of steel which may be hardened depending upon the use, manner and character of the striking member which is used to strike the fork and energize the mechanism. A resilient shock absorber 199 is positioned between plate 198 and fork 200 to reduce noise and unwanted wear upon the energizer mechanism. Within this outer fork 200 is carried energizer fork 201 and slidably carried within fork 201 is a small sear lifter fork 202. A guide pin 70 is mounted in holes provided in the base 20 and passes through slot 69 in energizer fork 201. This slot permits longitudinal motion of the energizer fork 201 while acting as the upper vertical guide. Aligned holes 207 in the lower portion of fork 201 carry pin member 58 which cocks the levers 51 and 52. The lower portion of energizer fork 201 is maintained in a slidable vertical alignment by means of vertical slots 59 formed in the side wall of the housing 20. One of these slots, identified as 59, is seen in FIG. 1 and also in FIG. 7. In the upper transverse portion of the energizer fork 201 is an aperture 208 through which passes a spring 197. The upper end of this spring is retained and positioned by means of a pin 210, seen in FIG. 6. The lower portion of this spring 197 engages the top of sear lifter fork 202. Pin 195 passes through slots 211 and 212 in outer fork 200 and also through slots 214 and 215 of the energizer fork 201 and also through holes 217 and 218 in the sear lifter fork 202. Pin 194 passes through spacer bushings 203 and the center aperture in the sear lifter 104. The ends of pin 194 also extend to and into slots 223 and 224 formed in energizer fork 201.

SEQUENCE OF OPERATION DEPICTED IN FIGS. 1 THRU 5

In FIG. 1, it is contemplated that the punch press or other apparatus providing the downward force to the outer fork 200 is at top dead center or at least is prior to its engagement on the downward stroke of wear pad 198. As reduced to practice, for the ejector size depicted about one and a half inches of stroke of downward movement of fork 200 is utilized. As shown, it is anticipated that the release of the ejector plunger 30 has occurred after the outer fork has moved upwardly approximately five-sixteenths of an inch. This allows the opening of the forming dies or whatever operation is to be performed on the workpiece to be ejected. The outer fork 200 is near its upward position as urged by springs 196. The sear lifter fork 202 is in its down or lowermost position as urged by spring 197 with the pin 195 being at the lower position in slots 211 and 212 and also in slots 214 and 215. The pin 194 is at the lower end of the travel in slots 223 and 224 in the energizer fork 201. As carried in the outer fork 200, the pin 70 which guides energizer fork 201 is at the lower end of the guide slots 69 in fork 201. The pin 58 carried by the energizer 201 in holes 207 is at its upward extent of the slots 59 formed in the side plates 20.

In FIG. 2, it is assumed that downward stroke of a punch press of like mechanism has engaged the wear plate 198 at some portion of its downward travel. The outer fork 200, the energizer fork 201 and the sear lifter fork 202 has traveled as a unit for the first part of a down stroke which is approximately one and three-sixteenths of an inch. During this downward stroke the sear lifter 104 wipes passed the sear 114, which as depicted in FIG. 2 is while the sear 114 is in the cocked and trigger holding position. Actuator levers 52 and 54 are in engagement with the shock absorber pad 170. A lost motion of approximately five-sixteenths of an inch is provided in this mechanism and is seen by the closeness of the underside of the energizer fork 201 and the top surface of sear lifter fork 202. Compare this with the spacing shown in FIG. 1. This allows for a desired delay of the ejection motion.

In FIG. 3, the fork 200 has reached or nearly reached its downward position and the sear lifter 104 has passed by the sear 114. In FIG. 5, the upward movement of the fork member has begun and the spring 197 has maintained the sear lifter fork 202 in its downward position while outer fork 200 has begun its upward movement and the pin 195 approaches the upper end of the slots 214 and 215. At this position the engaging end 134 of the sear lifter 104 begins to actuate the trigger release of the sear 114. During the upward stroke of the punch press or like apparatus the compression springs 196 urge the outer fork 200 upward and toward the upper limit as controlled by the travel of the sear lifter fork 202 in energizer fork 201. The lost motion of pin 70 provided in slots 69 results in the energizer fork 201 staying at its bottommost position as held down by the actuator lever spring 66. The actuator levers 52 and 54 are in a down position against the energy absorbing pad 170 while from the down position of FIG. 2 to the sear engaging position of FIG. 5, a five-sixteenths further gap is developed between the top of the sear lifter fork 202 and the underneath side of the energizer fork 201. During the rest of the upward movement of fork 202 there is no gap. This spring 197 is retained between the underside of the energizer fork 200 and the top of the sear lifter fork 202 and passes through the aperture 208 in the top of the energizer fork 201. As the spring urged energizer fork travels upward so also does the pin 195 which is common to all three forks. As the upward stroke of the punch press is achieved, it is assumed that the two compression springs 196 which have received their compression loading at the position of FIG. 2 are pushing the outer fork 200 upwardly.

The ejector release occurs after the completion of the desired operation upon the workpiece. As the outer fork travels upward about one-half inch, the slots 211 and 212 engage the common spring pin 195. This pin is a press fit in this sear lifter fork 202. The outer fork 200 and the sear lifter fork 202 will travel five-sixteenths of an inch further upward during which time triggering is effective before sear lifter fork 202 engages the underneath side of the energizer fork 201 and causes the energizer fork to be lifted. The three forks are then lifted about five-sixteenths of an inch at which point the trigger actuation provided by the sear lifter 104 causes the sear 114 to be lifted from shoulder 138 releasing the ejector 30 for spring propelled movement which now occurs. The three forks 200, 201 and 202 are then lifted one and three-sixteenths inches by the springs 196 to retrigger the ejector in the manner described in the above-referenced patent. The actuator levers 52 and 54 are moved upwardly until the pin 58 engages the top of the slot 59, as seen in FIG. 1.

In the typical sequence of a reduced-to-practice use, this ejector mechanism when used in a punch press having a die stroke of one and one-half inches or more may provide an ejection of a workpiece formed in a die requiring a forming depth of one-quarter inch between the upper and lower dies. Typically these upper and lower dies are open for a distance of five-sixteenths of an inch before the ejector plunger is released. During this upward stroke of five-sixteenths of an inch, the sear lifter 104 remains in its fully down position. The expansion of the compressed spring 197 and the upward movement of pin 195 in slots 214 and 215 and pin 194 in slots 223 and 224 provides the desired lost motion travel. A minimum travel of the ejector plunger might be three-eighths of an inch while the maximum plunger travel might be as much as one and one-quarter inches with this amount dependent upon the size of the apparatus.

It is anticipated that the ejector mechanism of this invention will, in many instances, be attached to lower die plate portions as used with and in a punch press. As an alternative to a punch press installation, a conveyor system may have an ejector mechanism associated therewith and arranged so that the ejector is used to reject certain workpieces that do not meet the desired standard and are rejected by an inspection method of some known means. Assuming, for example, that this apparatus is used in a punch press with forming dies, the ejector mechanism itself is fastened to the base plate of the press or to a lower die plate member. The ejector plunger 30 in its adjusted extended condition is arranged so that the end contacts and moves the formed workpiece after the workpiece has been formed, cut or a combination thereof. A sufficient stroke of the ejector plunger is provided so that when actuated it strikes the workpiece to move the workpiece from its position in the die to an accumulating bin. In order to mount and apply the ejector mechanism to a conventional die it is necessary that the designer establish the following data: (a) The working stroke of the die set. This, of course, is usually the stroke of the punch press. Alternately the die set may be moved only a determined amount which is less than the press stroke. This may be accomplished when the upper die set is pushed to its limited open condition by means of die springs and the ram acts as a striking hammer. (b) Orientation of the ejector mechanism. This requires the plunger to be located as to the orientation of the ejector plunger for both the amount of displacement impact and the direction of the ejector stroke on the workpiece. (c) The time of ejection. This time of ejection is established in relation to the opening of the dies after the bottom dead center of the press stroke has been accomplished. (d) Establish the ejector plunger path of travel. It is also necessary to determine the length of stroke necessary for the ejecting plunger to move the workpiece and return the plunger to a cocked condition free of the dies. (e) Determine the feed stroke in relation to the ram motion. In many instances it is necessary to keep in mind the feeding of strip stock into and between the dies. Usually the stock feed takes place while and with the plunger in its cocked position.

After determining the above parameters to establish a desired operating procedure it is necessary then to adjust the ejector mechanism as to its plunger stroke. This is accomplished by first removing the side covers 190 and 191 to expose the inside of the mechanism. The split clamp collar 32 is loosened and with the plunger in the fully retracted or cocked condition the clamp collar 32 is loosened by loosening the clamp screw 33 to permit the collar to be slid on the ejector plunger 30 to a calculated stroke distance. This length of the calculated stroke is set as the distance from the innerface of the clamp collar 32 to the outer face of the impact absorber ring 34. This is the desired stroke of the ejector plunger and establishes the parameter of the motion of the plunger 30. The crank head of the punch press is moved to determine where the start of the stock feed apparatus is to begin.

With the ejector mechanism mounted on the press or lower die plate, adjustment of the mechanism is begun. Levers 52 and 54 are moved to cause plunger 30 to be moved to derive approximately one-sixteenth of an inch additional spacing between the clamp collar 32 and the impact absorber 34.

The firing of the plunger is now adjusted and with the press ram at bottom dead center, as in FIGS. 5 and 6, the sear lifter 104 is moved so as to touch the stop pin 122. From this lower position approximately one-quarter of an inch movement is to take place before sear lifter 104 causes the sear 114 to release the plunger from its cocked position.

With the mechanism as now adjusted a slow try of the punch press is made. The stock for the workpiece is fit into the dies for the initial operation. During the up stroke of the press ram prior to the feeding of the first piece into the die, the upward movement of the energizer fork 201 causes the fork to lift the pin 58. The upward movement of the pin causes the levers 52 and 54 to be rotated counterclockwise and to move the spring anchor 36 leftwardly. The ejector plunger is moved leftwardly with the spring anchor 36 to its cocked condition. The energizer fork 201 and outer fork 200 are lifted upwardly by springs 196 until the outer fork reaches its top position as in FIG. 1, at which point the ejector plunger has been brought slightly past its normal cocked condition. The lower end of the sear 114 is urged into the notch provided by the groove 130.

As the ram and the die start to move downwardly, the wear plate 198 is engaged and fork 200 is carried downwardly as is the energizer fork 201. The fork 201 carries the clevis pin 58 downwardly to bring the levers 52 and 54 to the condition, as seen in FIG. 3. During this downward travel the sear lifter 104 is caused to pass by the sear in a wiping action, as seen in FIG. 2, with the full down position, seen in FIG. 3. The upward motion of the press ram then begins and as the die halves start to separate with the upper die moving upwardly springs 196 start to expand while spring 197 retaining the sear lifter 104 in its down position. Before the dies have reached their desired separation and approximately one-quarter of an inch before the desired striking action of the ejector plunger, the upward movement of outer fork 200 lifts the sear lifter 104. The release of the sear 114 from in way of the groove 130 causes the biased plunger to move to its forward limit of travel. At or just prior to this position the ejector plunger strikes the workpiece to be ejected and moves it from the dies. The further continued upward lifting of the forks 200, 201 and 202 causes the pin 58 to rotate the levers 52 and 54 to again cam the ejector plunger 30 to its cocked condition of FIG. 1 which is achieved when the dies are in fully opened condition and with the punch press ram at the top of its stroke.

The above discussion is more-or-less directed toward apparatus in which both the sear release action and the cocking of the ejector plunger is accomplished on the up stroke of the press ram with which the ejector mechanism is used. This, of course, is the logical time to achieve these operations which is as soon as the dies are sufficiently opened to allow the piece to be removed from the open dies. This allows the maximum amount of time for the feed-in of new stock between the time of ejecting of the piece and the closing of the dies on the advanced stock. Where the ejector mechanism is to be used with conveyors, separate control means may provide the best design. Each application, except where used with a press stroke mechanism, lends itself to specialized design but within the parameters provided by the above-description.

Terms such as "left", "right", "up", "down", "bottom", "top", "front", "back", "in", "out", "clockwise", "counterclockwise" and the like are applicable to the embodiment shown and described in conjunction with the drawings. These terms are merely for the purpose of description and do not necessarily apply to the position in which the stored energy mechanism may be constructed or used.

While a particular embodiment of this mechanism has been shown and described it is to be understood that modifications may be made within the scope of the accompanying claims and protection is sought to the broadest extent the prior art allows.

What is claimed is:

1. A stored energy ejector mechanism adapted for mounting on a punch press, a conveyor support and like apparatus wherein workpieces are to be selectively removed by the ejector mechanism at selected times in the operation thereof, said ejector mechanism including: (a) a housing; (b) an ejector plunger reciprocably carried in guideways provided in said housing; (c) biasing means associated with the ejector plunger and adapted to move the ejector rapidly in one direction; (d) means for limiting the extent of movement of the plunger in said one direction; (e) at least one actuator lever carried by the housing and movable so as to engage the plunger and move the plunger counterflow to the bias urged direction and to a "loaded" biased position; (f) an energizer fork operatively connected to the actuator lever, said energizer fork operatively moved from the topmost position and toward the base of the housing by striking means associated with the apparatus and with which the ejector mechanism is associated; (g) spring means which include at least one spring carried by the housing and arranged to provide the necessary biasing means required to move the energizer fork to a determined upward position and during this upward movement of the fork to its upwardmost position to move the actuator lever to its loaded condition; (h) means for establishing the limit of said upward position of the energizer fork; (i) trigger means in association with the ejector plunger and adapted to engage and retain said ejector plunger in a "cocked" condition as and after the actuator lever has moved the plunger to its biased loaded condition, and (j) trigger release means associated with and moved by the energizer fork to and during the beginning portion of the upward movement of this fork, said trigger release means when actuated removing the retaining engagement of the trigger and permitting the released plunger under the influence of the bias means to move rapidly to its extent of movement.

2. A stored energy ejector mechanism as in claim 1 in which' the moving of the ejector plunger from its "at rest" condition to its cocked condition is by a coupled pair of actuator levers pivotally carried by a pin mounted in the housing, the movement of the actuator levers being in response to the vertical portion of the movement of the energizer fork as moved by the bias provided by the spring carried by the housing and disposed to move said energizer fork upwardly.

3. A stored energy ejector mechanism as in claim 2 in which spring means which is arranged to move the energizer fork upwardly includes a pair of compression springs.

4. A stored energy ejector mechanism as in claim 2 in which the actuator levers are formed with like slot guideways in which a clevis pin is slidable, this clevis pin being reciprocably moved and carried by the energizer fork.

5. A stored energy ejector mechanism as in claim 1 in which the trigger mechanism includes a sear pivotally mounted on a shaft carried by the housing, said sear having a depending portion with a face adapted to engage a shoulder edge carried by the ejector plunger, the sear urged toward and into engagement with the ejector plunger by a bias means and when the shoulder edge in the ejector plunger is engaged providing a stop of the biased plunger in its cocked condition, and a sear lifter carried by a reciprocably moved sear lifter fork, the sear lifter adapted to pass by an engaging shoulder portion of the sear during the downward movement of the sear lifter fork and during a portion of the upward stroke of this sear lifter fork the sear lifter is brought into engagement with the engaging shoulder portion of the sear to cause the sear to rotate on its support shaft sufficiently to disengage the depending face of the sear from in way of the shoulder edge of the plunger to release the plunger from its cocked position.

6. A stored energy mechanism as in claim 5 in which the shoulder edge of the ejector plunger is an undercut in the ejector plunger and in which the sear lifter is pivotally carried on a clevis pin mounted in the depending end of the lifter fork, the sear lifter fork having stop means for limiting a rotary motion of the sear lifter around the pin in one direction while being formed so as to rotate at least 60° around the pin in the other direction during the passing of the sear lifter by the engaging shoulder of the sear.

7. A stored energy ejector mechanism as in claim 6 in which the downward movement of the sear as carried by the sear lifter fork causes the sear lifter to be moved past the sear, the downward movement of the sear lifter positively limited in its downward travel by a stop pin which is in way of the path of the sear lifter.

8. A stored energy ejector mechanism as in claim 7 in which the sear lifter fork carries the energizer fork and there is provided a determined lost motion means whereby the energizer fork is caused to remain at its lowermost position as and while the sear lifter fork begins to be and is moved upwardly for this determined lost motion distance as urged by the spring means carried by the housing.

9. A stored energy ejector mechanism as in claim 8 in which there is provided biasing means which is disposed to engage and urge the sear lifter fork to its lowermost postion in relation to the outer fork.

10. A stored energy ejector mechanism as in claim 8 in which the energizer fork and the sear lifter fork are carried by and movable with an outer fork which is operatively connected to and carries the energizer fork, the outer fork having means providing engagement with the upper ends of the compression springs to cause the outer fork to be lifted upwardly to its topmost position, said outer fork having a lost motion relationship with the energizer fork such that during the initial downward movement of the outer fork the energizer fork is not likewise moved downwardly.

11. A stored energy ejector mechanism as in claim 10 which further includes means provided on the outer fork for the striking of a portion of this fork to move it downwardly and in which both the cocking action and the trigger release action occurs during a combined motion of the outer, energizer and sear lifter forks.

12. A stored energy ejector mechanism as in claim 11 in which the same motion for the cocking and trigger release of action is the upward motion of the outer, energizer and sear lifter forks and in which both the triggering action of the sear lifter fork and the loading action of the energizer fork are both adjustable externally, their actuation occuring with respect to a position in the cycle which occurs after the bottom dead center of the actuating downward stroke has been achieved.

* * * * *